United States Patent [19]

Chabala

[11] Patent Number: 5,013,876

[45] Date of Patent: May 7, 1991

[54] SWITCH CONTACTS WITH IMPROVED FAULT-CLOSING CAPABILITY

[75] Inventor: Leonard V. Chabala, Maywood, Ill.

[73] Assignee: S&C Electric Company, Chicago, Ill.

[21] Appl. No.: 242,989

[22] Filed: Sep. 12, 1988

[51] Int. Cl.[5] ..... H01H 1/42; H01H 1/60

[52] U.S. Cl. ..... 200/254; 200/252; 200/253; 200/144 R; 200/146 R

[58] Field of Search ..... 200/144 R, 146 R, 252, 200/253, 254

[56] References Cited

U.S. PATENT DOCUMENTS

| | | | |
|---|---|---|---|
| 2,830,144 | 4/1958 | Fjellstedt | 200/48 |
| 3,174,004 | 3/1965 | Stene et al. | 200/48 |
| 3,361,879 | 1/1968 | Booth | 200/48 |

OTHER PUBLICATIONS

*Re: Porter* publication, Sep. 1960, H. K. Porter Co., 2 pages.

Morris Catalogue No. 35, "V Range Minor Disconnectors," 4 pgs.

Delta Star Brochure EL-2117, "Type MK-40A . . . Disconnect," p. 8, and front and back covers, undated.

Delta-Star Catalog 1-012, "MK-40A . . . Disconnect Switch," front cover and p. 4, undated.

Delta-Star Catalog 1-013, "Vertical Break Air Switches," front cover and pp. 6 and 7, Revised 5-79.

*Primary Examiner*—Robert S. Macon

*Attorney, Agent, or Firm*—James V. Lapacek

[57] ABSTRACT

A contact arrangement is provided for a medium- or high-voltage switch including two contact surfaces that are generally parallel and relatively movable via a predetermined path between open and closed positions. During closing, the two contact surfaces define predetermined areas of relative engagement between the two contact surfaces. The movement along the predetermined path during contact engagement generally defines a first direction. The two contact surfaces are arranged relative to each other and the first direction such that, during closing, the relative engagement between the two contact surfaces defines a locus along each contact surface that is non-parallel to the first direction.

11 Claims, 3 Drawing Sheets

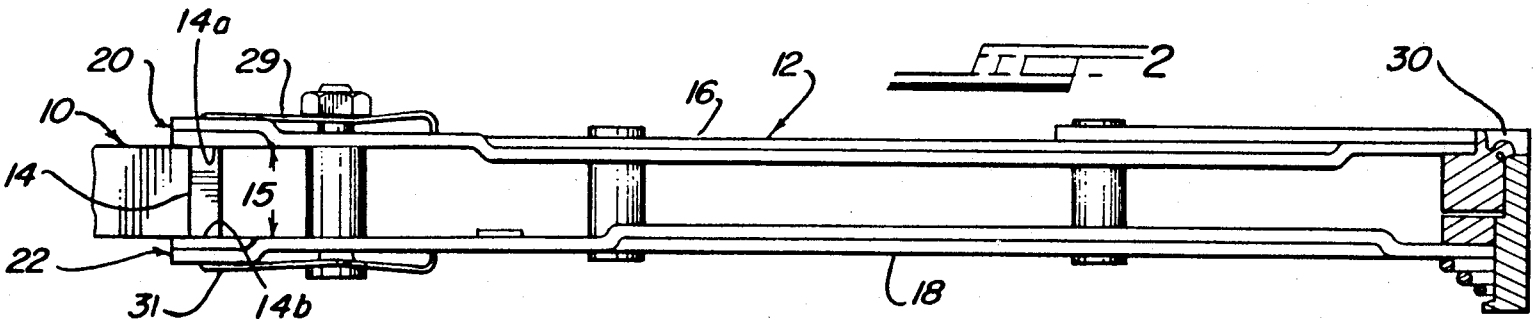
30
2
18
12
16
29
15
14b
14a
20
10
14
22
31
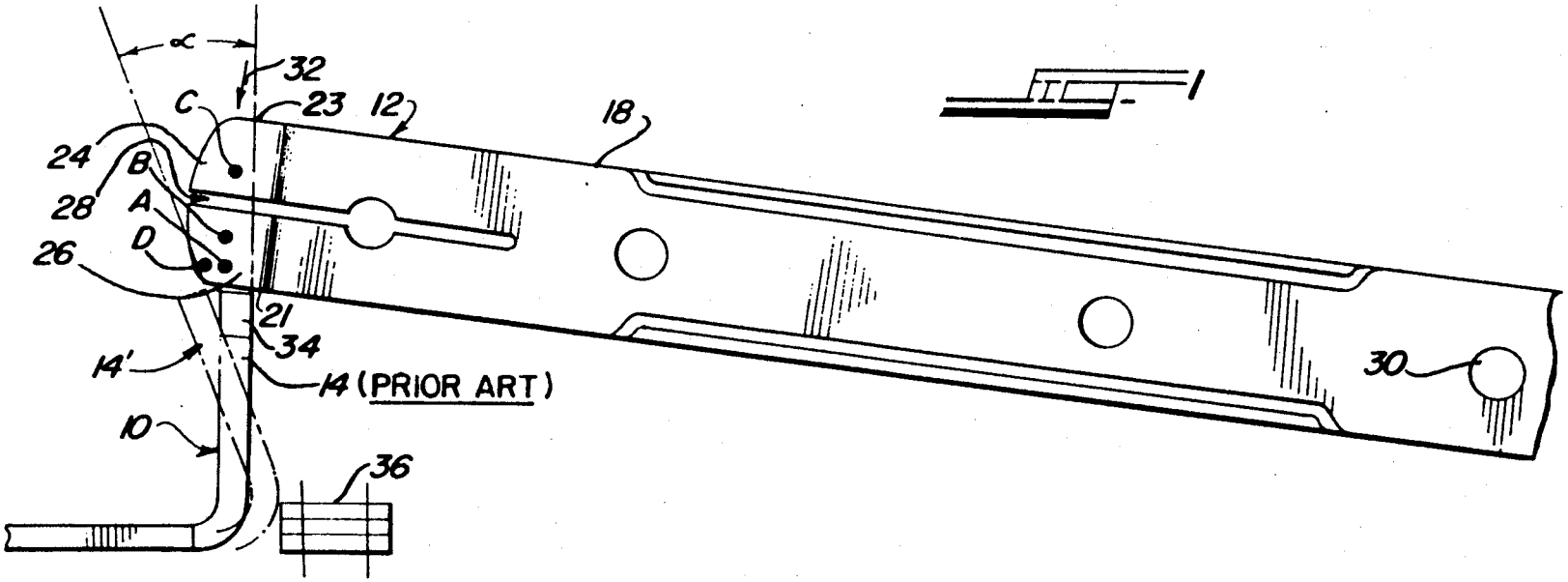
1
30
18
12
14 (PRIOR ART)
36
32
23
21
34
α
C
B
A
D
24
28
26
14'
10

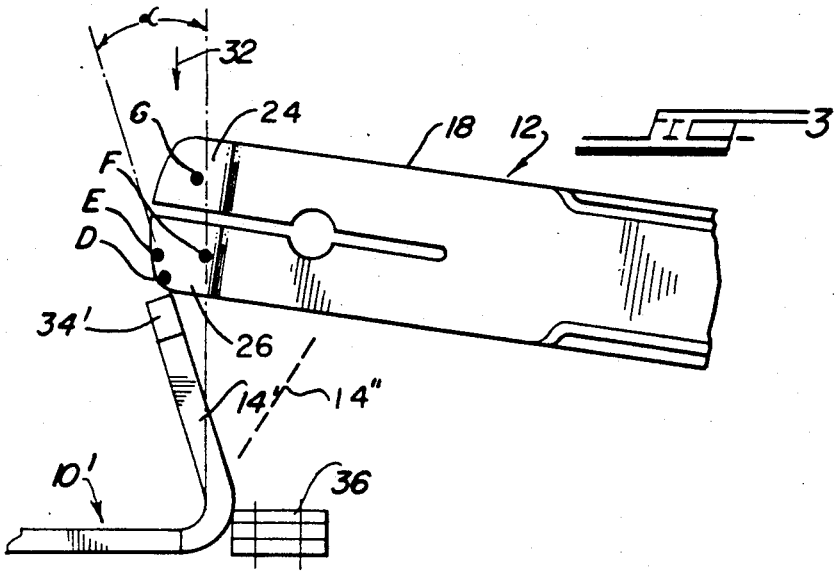
FIG. 3
FIG. 5
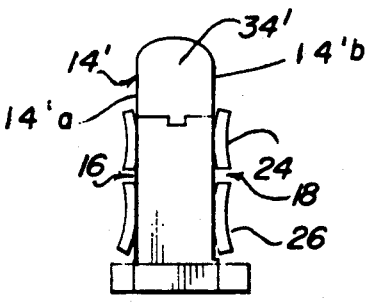
FIG. 4
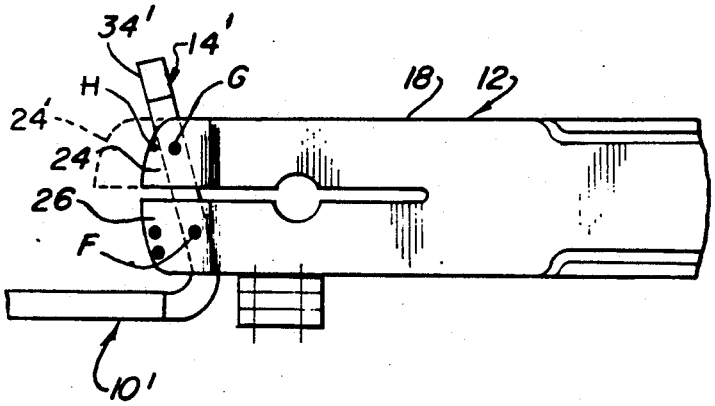

SWITCH CONTACTS WITH IMPROVED FAULT-CLOSING CAPABILITY

BACKGROUND OF THE INVENTION

1. Field of the Invention

The present invention relates generally to the field of switch contacts and more particularly to an arrangement with improved fault-closing capability.

2. Description of the Related Art

When switch contacts of medium- and high-voltage switches are being closed, arcing may occur between the contacts either prior to or during initial contact engagement. The magnitude of the arcing is generally proportional to the available current in the circuit. The length of the arcing time is determined by factors such as voltage, the configuration of the contacts, and the speed of closing. Accordingly, in the presence of large currents (e.g., in the range of thousands of amperes) and/or long time durations, any resultant arcing and/or current flow during initial contact engagement can cause rather severe erosion of the contacts. Depending on the current level involved, one or more of such contact closings can result in impairment and reduction of the desirable current-carrying capacity of the switch contacts when the switch contacts are in their fully closed position with the contacts fully engaged. For example, the contact erosion can result in the absence of contact in the area of normal desired contact engagement when the contacts are in the fully closed position.

To limit and/or mitigate such contact erosion, the contacts may be provided with arcing tips or portions of arc-resistant material especially suited to avoid or minimize contact erosion; e.g., refractory material. For example, see U.S. Pat. No. 3,787,651. Of course, this adds to the complexity and cost of the manufacture of the contacts. Alternatively, an additional contact pair may be provided as a sacrificial contact pair to accommodate the arcing effects. However, this too results in a more complex and costly structure.

While the aforementioned arrangements may be generally suitable for their intended use, they do not efficiently provide for the accommodation of any arcing effects that result when two relatively movable contacts are closed.

SUMMARY OF THE INVENTION

Accordingly, it is a principal object of the present invention to provide improved fault-closing capability for a contact pair which are relatively movable between open and closed positions.

It is another object of the present invention to provide an improved contact arrangement having two contacts that are arranged relative to each other and to the direction of contact closing such that, during closing, the relative engagement between the contacts moves along each contact in a direction non-parallel to the direction of relative movement of the contacts.

These and other objects of the present invention are efficiently achieved by providing a contact arrangement for a medium- or high-voltage switch including two contact surfaces that are generally parallel and relatively movable via a predetermined path between open and closed positions. During closing, the two contact surfaces define predetermined areas of relative engagement between the two contact surfaces. The movement along the predetermined path during contact engagement generally defines a first direction. The two contact surfaces are arranged relative to each other and the first direction such that, during closing, the relative engagement between the two contact surfaces defines a locus along each contact surface that is non-parallel to the first direction.

BRIEF DESCRIPTION OF THE DRAWING

The invention, both as to its organization and method of operation, together with further objects and advantages thereof, will best be understood by reference to the accompanying drawing in which:

FIG. 1 is a plan view of a contact arrangement that illustrates a prior art configuration as well as illustrating the present invention in phantom;

FIG. 2 is a top elevational view of the contact arrangement of FIG. 1;

FIG. 3 is a partial view of the contact arrangement of FIG. 1 illustrating an orientation of the contacts in accordance with the present invention and with the contacts in a partially closed position, FIG. 4 is an elevational view of the contact arrangement of FIG. 4 illustrating the contacts in the fully closed position;

FIG. 5 is a side elevational view of the contact arrangement of FIG. 4.

DETAILED DESCRIPTION

Figure 6:
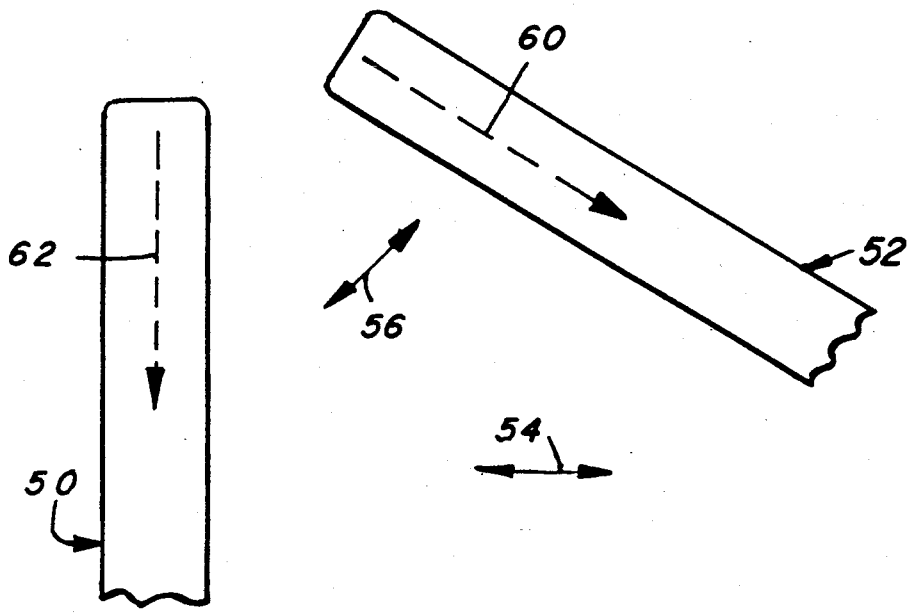
FIGS. 6 and 7 are diagrammatic representations of alternate configurations of the contact arrangement of the present invention.

While the contact arrangement of the present invention will be described in connection with a specific illustrative embodiment, it should be understood that the present invention is applicable to various contact configurations. Accordingly, the specific illustrative embodiment should not be interpreted in any limiting sense.

Referring now to FIGS. 1–2, relatively movable contact assemblies 10 and 12 are illustrated in a partially closed position at which arcing may occur as dependent upon the contact assemblies 10 and 12 being connected in a circuit configuration of sufficient voltage and current. The contact assembly 10 includes a tongue-shaped generally planar contact 14. The contact assembly 12 includes two spaced-apart blade members 16,18 that carry respective generally planar contacts 20,22. Each of the contacts 20,22 is fabricated so as to form individual contact finger portions 24,26 separated by a gap 28. As shown in FIG. 5, the contact finger portions 24,26 include a convex shape along the inner portions which engage the contact 14 at contact surfaces 14A,14B respectively, so as to define predetermined points of contact engagement and desired contact pressure. In a specific arrangement, the blades 16,18 are pivotally mounted at 30 while the contact 14 is stationary. The blades 16,18 are oriented so as to be substantially perpendicular to the plane of the contact 14. Additionally, in the specific illustration of FIGS. 1–2, the contacts 20,22 of the blades 14,16 are resiliently biased by spring members 29,31 (FIG. 2) to provide an interference fit with the dimension 15 of the contact 14. In this manner, desirable contact pressure is established when the contact assemblies are in the fully closed position. (For clarity, the spring members 29,31 are not shown in FIG. 1.) A stop member 36 is provided in a specific arrangement to define the fully closed position in combination with the blades 16,18.

As the blades 16,18 are moved in the direction 32, it can be seen from FIG. 1 that the stationary contact 14 is aligned so as to be generally perpendicular to the edges 21,23 of the contacts 20,22 and is generally aligned with the direction of approach 32 defined by the relative movement between the contact finger portions 24,26 of the contacts 20,22 and the stationary contact 14. In this configuration, assuming a circuit is completed, arcing current and/or initial current flow will initiate at a point A on the contact finger portions 26. As the blades 16,18 continue to close, additional contact will be made along a line from point A to a point B and eventually on the other contact finger portions 24 at point C. When large currents are encountered upon closure of the contact assemblies 10,12, erosion of the contact material will occur and will be severe at point B. If the contact 14 includes a tip portion 34 of arc-resistant material, the contact 14 will experience only small amounts of erosion.

If the current upon closing is sufficiently large and/or if the contacts are closed a number of times, the erosion of the contacts 20,22 between the points A to B may result in the absence of contact between the contact 14 (at 14A,B) and the contact finger portions 26 at point B. Subsequentclosing will then cause progressive erosion of the contact portions 24 toward the point C. Of course, such erosion and absence of metallic contact between the contacts reduces the current-carrying capability of the contact assemblies 10,12 in the fully closed position.

In accordance with important aspects of the present invention, the contacts 14, 20, and 22 are relatively arranged and oriented such that during closing, the relative engagement between the contacts defines a locus along each contact that is non-parallel to the direction of relative movement 32. In the specific illustrative embodiment, the contact 14 is oriented as shown in the phantom position 14' in FIG. 1; i.e., the plane of the contact 14' forms a predetermined angle of intersection $\alpha$ from the generally aligned position of FIG. 1 to provide the configuration of FIGS. 3 and 4. The angle $\alpha$ is sufficient to cause the closing arcing erosion to occur in a region or site that is not essential for carrying current when the contacts are in the fully closed position.

Specifically, as shown in FIG. 3, arcing and/or initial current flow that may occur on closing will take place between the arc-resistant tip 34' of the contact 14' and the contact portions 26 at a point D. With large currents and/or after successive closures, the contact erosion will tend to move along the path from the point D to a point E. Referring now to FIGS. 4 and 5, when the contacts 14', 20, and 22 are fully closed, relative contact engagement or overlap occurs in a region about a point F; i.e., the location of contact engagement in the fully closed position that determines current-carrying capacity. Thus, it can be seen that the relative contact engagement during closing defines a locus along contact portion 26 .from point D or E to F. Similarly, relative contact engagement or overlap occurs in a region about a point G on the contact portions 24. Accordingly, the orientation of the contact 14' permits a substantially larger degree and amount of erosion to occur before the rated current-carrying capacity is reduced as compared to the arrangement of FIG. 1. This is accomplished since the arcing erosion occurs at portions of the contacts that do not provide contact engagement in the fully closed position and thus are not utilized to carry current. It should also be noted that if the closing occurs without significant arcing, the relative engagement of the contact 14, and the contact finger portions 26 traverse from the point E to the point F; the relative contact engagement of the present invention not being restricted about a single point, as is the case with the configuration of FIG. 1. This distributes the effects of wear and would be expected to result in an improvement of the mechanical life of the contacts. Similarly, the engagement of the contact 14' and the contact finger portions 24 traverses from a point H to the point G.

In an illustrative embodiment not to be interpreted in any limiting sense, an angle $\alpha$ of approximately 10° has been found suitable for the practice of the present invention to achieve a tripling in the number of fault closings that can be accomplished compared to the arrangement of FIG. 1; e.g., three fault closings instead of one. However, it can be seen that various other angles are also useful and that angles of 45° and greater can be utilized. It can also be seen that angles as low as a few degrees can also provide beneficial effects. Of course, consideration must be given to the effect of the angle $\alpha$ upon the electromagnetic forces experienced during closing (especially for higher angles). Additionally, consideration should also be given such that the angle $\alpha$ is large enough to achieve a desirable distance between the point of the contact when initial arcing takes place and the area that determines current-carrying capacity. The angle $\alpha$ also depends upon the contact configuration. For example, if the contact finger portions 26 alone were utilized, larger angles $\alpha$ would be desirable. Further, if the contact finger portions 24' (indicated in phantom in FIG. 4) extended beyond the contact finger portions 26, a larger angle $\alpha$ would be desirable. It should also be noted that in specific embodiments, the angle $\alpha$ could also be defined in the opposite or negative direction as illustrated in FIG. 3 such that the contact 14' assumes the orientation indicated in phantom as 14'. The lower angles cause the area of arcing erosion and the area of relative engagement in the fully closed position to be relatively close together, while the larger angles require relatively larger contacts in a direction generally perpendicular to the direction of relative movement.

While there have been illustrated and described various embodiments of the present invention, it will be apparent that various changes and modifications will occur to those skilled in the art. For example, various contact configurations are possible in specific embodiments such that the arcing erosion that may occur does not affect the current-carrying capacity of the contacts since the contacts are oriented so that the arcing erosion occurs sacrificially at a location different than the relative engagement portions which determine current-carrying capacity. Thus, it should be realized that the present invention is not limited to the specific shape of the contacts. It should also be realized that the relative movement between the two contacts can be achieved in various manners.

Figure 7:
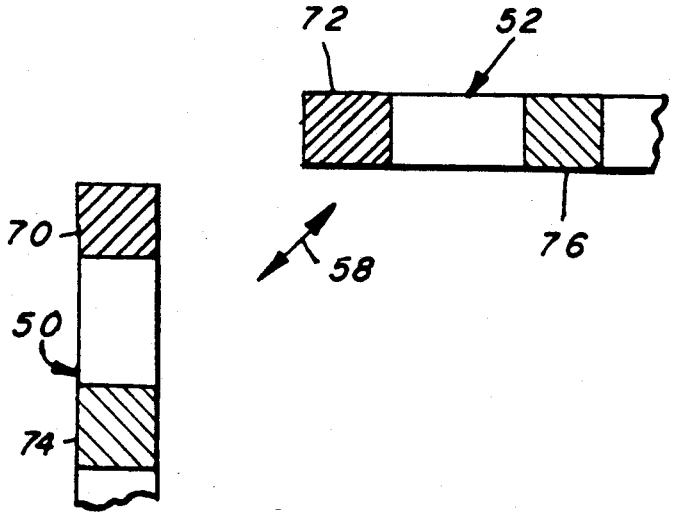

For example, although the specific illustrative embodiment of FIGS. 3–5 demonstrates the operation and features of the present invention, it should be realized that other configurations as to contact shapes and orientations will also provide the desirable features of the present invention as long as two contacts are relatively arranged and oriented with respect to each other and the direction of relative movement such that during closing, the relative engagement between the contacts defines a locus along each contact that is non-parallel to the direction of relative movement. Referring to FIGS. 6 and 7, the contacts 50,52 (which may also be referred to as contact surfaces or including contact surfaces) are relatively oriented with respect to each other and the direction of relative movement to provide the features of the present invention. Illustrative directions of relative movement 54, 56, and 58 are referred to in FIGS. 6 and 7 by bidirectional arrows. In the arrangement of FIG. 6, with relative movement described by 56, it can be seen that relative contact engagement defines a locus 60 on contact 52 and 62 on contact 50; neither of the loci 60,62 being parallel to the direction of relative movement 56. The loci 60,62 can also be characterized as the point of contact moving along each of the contacts 50,52. For the case of elongated contact members 50,52, the orientation of the contacts 50,52 to achieve the features of the present invention can also be characterized as (1) the direction of relative movement not being aligned with the longitudinal axis of either contact, (2) the direction of movement of a movable contact (e.g., direction 54 with movable contact 50) not being parallel to the longitudinal axis of the stationary contact (e.g., contact 52), or (3) the direction of relative movement not being parallel to the longitudinal axis of either contact. It can also be seen from the various embodiments that the areas of contact on each contact that are defined by relative contact engagement during closing are entirely distinct and mutually exclusive from the areas of relative contact engagement when the contacts are in the closed position. For example, in FIG. 7, the areas 70,72 defined by relative contact engagement during one stage of closing on each of the respective contacts 50,52 are entirely distinct from the areas 74,76 defined by relative contact engagement in a predetermined fully closed position.

What is claimed and desired to be secured by Letters Patent of the United States is:

1. A contact arrangement for a medium- or high-voltage switch including two contact surfaces that are generally parallel and relatively movable via a predetermined path between open and closed positions, the movement along the predetermined path generally defining a first direction during movement to the closed position, during closing, said two contact surfaces defining predetermined areas of relative engagement between said two contact surfaces, the improvement comprising configuring, orienting and arranging said two contact surfaces relative to each other and said first direction such that, during closing, the relative engagement between the two contact surfaces defines a locus along each contact surface that is non-parallel to said first direction and such that the areas of relative engagement that are defined for each of said two contact surfaces are totally independent of and different from said predetermined areas of relative engagement in said closed position.

2. The contact arrangement of claim 1 wherein said two contact surfaces are arranged such that said locus for at least one of said contacts defines a predetermined angle with respect to said first direction.

3. The contact arrangement of claim 1 wherein each of said contact surfaces is defined by a generally elongated contact member, the longitudinal axes of each of said generally elongated contact members forming an angle of at least approximately 5° from said first direction.

4. The contact arrangement of claim 1 wherein a first of said two contact surfaces is defined by a first generally planar member and said second of said two contact surfaces is carried by a second generally planar member which is arranged generally perpendicularly to said first generally planar member, said second contact surface being defined at a first edge of said second generally planar member that is generally perpendicular to the plane of said second generally planar member.

5. The contact arrangement of claim 4 further comprising a third contact surface that is generally parallel to said second contact surface and that is defined on said second generally planar member, and a fourth contact surface generally parallel to said first contact surface and arranged for engagement with said third contact surface, said second and third contact surfaces and said first and fourth contact surfaces being spaced apart to establish appropriate contact engagement.

6. The contact arrangement of claim 5 further comprising means for resiliently biasing said first and fourth contact surfaces toward each other.

7. The contact arrangement of claim 5 wherein said second generally planar member includes a predetermined cross section.

8. The contact arrangement of claim 1 wherein said two contact surfaces are defined by generally planar members, said generally planar members being arranged generally perpendicularly to each other.

9. The contact arrangement of claim 1 where at least one of said two contact surfaces includes an arc-resistant portion arranged to be first engaged during closing.

10. A contact arrangement defining two contact surfaces that are relatively movable via a predetermined path between open and closed positions, predetermined areas of engagement being defined on said two contact surfaces when said two contact surfaces are in said closed position, said contact surfaces being relatively oriented and arranged with respect to each other and said first direction such that areas of engagement totally independent of and different from said predetermined areas of engagement are defined on each of said two contact surfaces as said two contact surfaces are relatively moved between said open and closed positions.

11. A contact arrangement including two contacts that are relatively movable via a predetermined path between open and closed positions, the improvement comprising configuring orienting and arranging said two contacts relative to each other and said predetermined path such that, during closing, areas of engagement are defined for each of said two contacts that are distinct and mutually exclusive from the areas defined when said two contacts are in the closed position.

* * * * *

UNITED STATES PATENT AND TRADEMARK OFFICE

CERTIFICATE OF CORRECTION

PATENT NO. : 5,013,876

DATED : May 7, 1991

INVENTOR(S) : Leonard V. Chabala

It is certified that error appears in the above-identified patent and that said Letters Patent is hereby corrected as shown below:

Col. 3, line 25, "Subsequentclosing" should be -- Subsequent closing -- (insert space);

Col. 4, line 2, "14," should be -- 14' --;

Col. 4, line 38, " 14' " should read -- " 14'' "--.

Signed and Sealed this

Thirteenth Day of October, 1992

*Attest:*

DOUGLAS B. COMER

*Attesting Officer*

*Acting Commissioner of Patents and Trademarks*